US008931869B2

(12) United States Patent
Kawafuji

(10) Patent No.: US 8,931,869 B2
(45) Date of Patent: Jan. 13, 2015

(54) INKJET PRINTING APPARATUS AND INKJET PRINTING METHOD

(75) Inventor: Hiroshi Kawafuji, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 121 days.

(21) Appl. No.: 13/584,311

(22) Filed: Aug. 13, 2012

(65) Prior Publication Data

US 2013/0044150 A1 Feb. 21, 2013

(30) Foreign Application Priority Data

Aug. 18, 2011 (JP) ..... 2011-178944

(51) Int. Cl.

| | |
|---|---|
| ***B41J 2/01*** | (2006.01) |
| ***B41J 2/21*** | (2006.01) |
| ***B41J 29/38*** | (2006.01) |
| ***B41J 19/14*** | (2006.01) |

(52) U.S. Cl.

CPC ..... *B41J 29/38* (2013.01); *B41J 2/2132* (2013.01); *B41J 19/147* (2013.01)

USPC ..... 347/9; 347/12

(58) Field of Classification Search

USPC ..... 347/5, 9, 12, 41

See application file for complete search history.

(56) References Cited

U.S. PATENT DOCUMENTS

| | | | | |
|---|---|---|---|---|
| 6,789,867 | B2 * | 9/2004 | Takahashi et al. | 347/12 |
| 8,292,391 | B2 * | 10/2012 | Ishimoto et al. | 347/14 |
| 8,562,107 | B2 * | 10/2013 | Tamai et al. | 347/41 |
| 2002/0154182 | A1 | 10/2002 | Takahashi et al. | |

FOREIGN PATENT DOCUMENTS

JP 2002-307672 A 10/2002

* cited by examiner

*Primary Examiner* — Huan Tran

(74) *Attorney, Agent, or Firm* — Fitzpatrick, Cella, Harper & Scinto

(57) ABSTRACT

In a serial type of color inkjet printing apparatus having a plurality of nozzle arrays, overlapping areas are provided in the respective operating nozzle areas, but printing of a high-quality image can be achieved without color banding and gloss variations accompanying non-uniformity in the ink application process. To attain this, while the operating nozzle areas of the plurality of nozzle arrays partially overlap with each other, the overlapping area of the operating nozzle area of each nozzle array is set to be equal to an integral multiple of the amount of conveyance. In consequence, the ink application process for the entire image area is made uniform.

22 Claims, 11 Drawing Sheets

INKJET PRINTING APPARATUS AND INKJET PRINTING METHOD

BACKGROUND OF THE INVENTION

1. Field of the Invention

This invention relates to a printing method for reducing harmful effects on images such as color banding and gloss variations caused by what order to apply inks to a print medium in a serial type of color inkjet printing apparatus. In particular, the invention relates to a printing method of varying, depending on a print mode, a nozzle area used for printing in each of a plurality of nozzle arrays provided for each ink color to lessen the above-described harmful effects.

2. Description of the Related Art

A serial type of color inkjet printing apparatus prints an image by performing, in alternate order, a printing scan for ejecting ink toward a print medium while moving a plurality of nozzle arrays provided for each color and a conveying operation of conveying the print medium by a distance corresponding to a print width of the printing scan. Such an inkjet printing apparatus typically employs a multi-pass printing method for improving image quality or performs bidirectional printing for reducing the printing time. In the multi-pass printing, an image is completed in stages by performing a plurality of printing scans of the print head on an image region can be printed by one printing scan. Between the respective printing scans, the conveying operation is performed to convey the print medium by a distance shorter than the print width of the print head. By performing such multi-pass printing, dots are not printed continuously in the main scan direction by one single nozzle. This makes it possible to scatter variations in ejection characteristics among individual nozzles over the entire image, resulting in improved uniformity of the entire image Now, it is known that, in color inkjet printing apparatus, the ink application order in which inks are applied to a print medium may possibly has an effect on color reproduction of an image. For example, when a single green image is printed by ejecting inks respectively from a cyan nozzle array and a yellow nozzle array which are arranged side by side in the main scan direction, if the image is printed in order of cyan and then yellow in the forward scan, the image is printed in order of yellow and then cyan in the backward scan. Such two images printed by reversing the ink application order differ from each other in color reproduction, so that color banding may possibly be recognized on a band-to-band basis.

It should be noted that, if the multi-pass printing as described above is performed, since ink is applied to a unit area of the print medium by both of printing in the forward scan and printing in the backward scan, the color banding can be lessened to some degree. However, in a case of a large amount of applied ink or a small number of passes in the multi-pass printing, it is difficult to obscure the color banding to perfection. If the number of passes is increased, the throughput is reduced.

In such circumstances, for example, Japanese Patent Laid-Open No. 2002-307672 discloses the structure in which, depending on a print mode, the operating area of the nozzle array in the conveying direction is changed independently for each color. According to Japanese Patent Laid-Open No. 2002-307672, for example, in a high-quality print mode of placing prime importance on image quality, the operating area in the nozzle array is set to a different position depending on an ink color such that the ink application order in which the inks are applied to a print medium is not reversed even during bidirectional printing. On the other hand, in a high-speed print mode of placing prime importance on printing speeds, the operating area of each nozzle array is extended to the maximum for printing.

According to Japanese Patent Laid-Open No. 2002-307672 as described above, it becomes possible to implement a high-quality mode for no occurrence of color banding and a high-speed print mode for a faster output speed in one single inkjet printing apparatus.

However, although Japanese Patent Laid-Open No. 2002-307672 discloses the structure of completely separating the operating areas of two nozzle arrays from each other in the conveying direction, that is, of preventing overlapping of the respective operating areas of two nozzle arrays in the conveying direction, it does not describe in detail the structure of using print heads for three or more colors. If such a structure as described in Japanese Patent Laid-Open No. 2002-307672 is implemented in a printing apparatus having nozzle arrays for three or more colors without any change, the number of nozzles actually used in the high-quality mode is extremely smaller than the number of nozzles of each nozzle array, resulting in a significant increase in print time.

Accordingly, a structure is employed actually, in which, while the operating areas of the nozzle arrays for two ink colors of which color banding are the most eye-catching are prevented from overlapping each other, a nozzle operating area for each of other ink colors is designed to partially overlap another nozzle operating area for another ink color of them. In such cases, however, according to the assiduous study of the inventors, it is found that color banding and gloss variations are produced depending on an amount of overlapping of a plurality of nozzle arrays overlapping with each other.

SUMMARY OF THE INVENTION

The present invention has been made to address the aforementioned disadvantages. Accordingly, it is an object of the present invention to achieve high-quality image printing in a serial type of color inkjet printing apparatus having a plurality of nozzle arrays in which an overlapping area is provided in each operating area to overlap another operating area, but color banding and gloss variations accompanying non-uniformity in an ink application process are not produced.

In a first aspect of the present invention, there is provided an inkjet printing apparatus, which prints an image on a print medium by performing, in alternate order, a printing scan in which a plurality of nozzle arrays each including a plurality of nozzles arranged in a predetermined direction are moved relative to the print medium, and a conveying operation of conveying the print medium in the predetermined direction, comprising: a setting unit configured to set an operating nozzle area operated for printing to a middle region of the print medium in the nozzle array, for each of the plurality of nozzle arrays; a unit configured to execute the printing scan by moving the plurality of nozzle arrays in a direction crossing the predetermined direction while ink is ejected from the operating nozzle area set by the setting unit; and a unit configured to execute the conveying operation of conveying the print medium in the predetermined direction by an amount of conveyance determined depending on a set print mode, wherein the setting unit sets the operating nozzle area for each of the plurality of nozzle arrays in such a condition that an overlapping area in the predetermined direction of the operating nozzle area between the plurality of nozzle arrays becomes an integral multiple of the amount of conveyance.

In a second aspect of the present invention, there is provided an inkjet printing method for printing an image on a print medium by performing, in alternate order, a printing scan in which a plurality of nozzle arrays each including a plurality of nozzles arranged in a predetermined direction are moved relative to a print medium, and a conveying operation of conveying the print medium in the predetermined direction, comprising: a setting step of setting an operating nozzle area operated for printing to a middle region of the print medium in the nozzle array, for each of the plurality of nozzle arrays; a step of executing the printing scan by moving the plurality of nozzle arrays in a direction crossing the predetermined direction while ink is ejected from the operating nozzle area set by the setting step; and a step of executing the conveying operation by conveying the print medium in the predetermined direction by an amount of conveyance determined depending on a set print mode, wherein the setting step sets the operating nozzle area for each of the plurality of nozzle arrays in such a condition that an overlapping area in the predetermined direction of the operating nozzle area between the plurality of nozzle arrays becomes an integral multiple of the amount of conveyance.

Further features of the present invention will become apparent from the following description of exemplary embodiments with reference to the attached drawings.

Further features of the present invention will become apparent from the following description of exemplary embodiments (with reference to the attached drawings).

DESCRIPTION OF THE EMBODIMENTS

Embodiments relating to a printing method according to the present invention will be described below with reference to the drawings.

Figure 1:
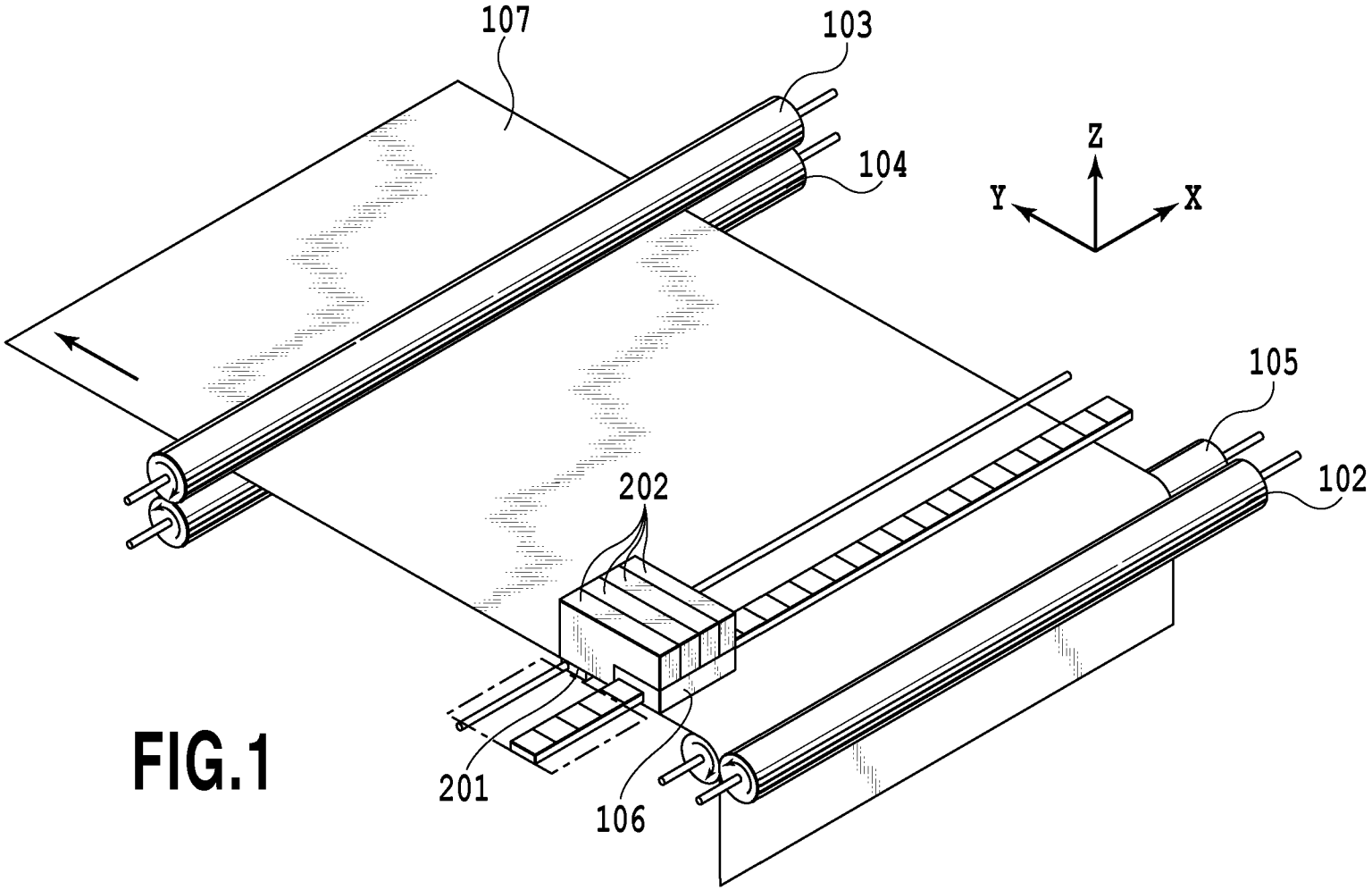
FIG. 1 is a schematically perspective view illustrating the structure of a color inkjet printing apparatus.

FIG. 1 is a schematic perspective diagram showing the structure of a color inkjet printing apparatus to which the present invention can be applied. A printing apparatus in the present embodiment uses four colors of inks of cyan, magenta, yellow and black to print a color image, and is provided with four ink cartridges 202 intended for the ink colors. Each of the ink cartridges 202 includes an ink tank storing one of the black, cyan, magenta and yellow inks, and a print head 201 from which the ink supplied from the tank is ejected. A carriage 106 mounted with the four ink cartridges 202 is capable of reciprocating in the X direction (main scan direction) in FIG. 1, so that the print head 201 ejects ink in response to a print signal during the movement of the carriage 106.

On the other hand, a print medium 107 is held by a first roller pair made up of a feeding roller 105 and an auxiliary roller 102 and a second roller pair made up of a conveying roller 103 and an auxiliary roller 104 such that an area of the print medium 107 on which printing is performed by the print head 201 is maintained to be even. Upon completion of a print main scan by the print head 201, the feeding roller 105 and the conveying roller 103 rotate to convey the print medium 107 by a predetermined distance in the Y direction (conveying direction) crossing the X direction. As described above, the repetitive alternation between the printing scan by the print head and the conveying operation allows an image to be printed on the print medium in stages.

Figure 2:
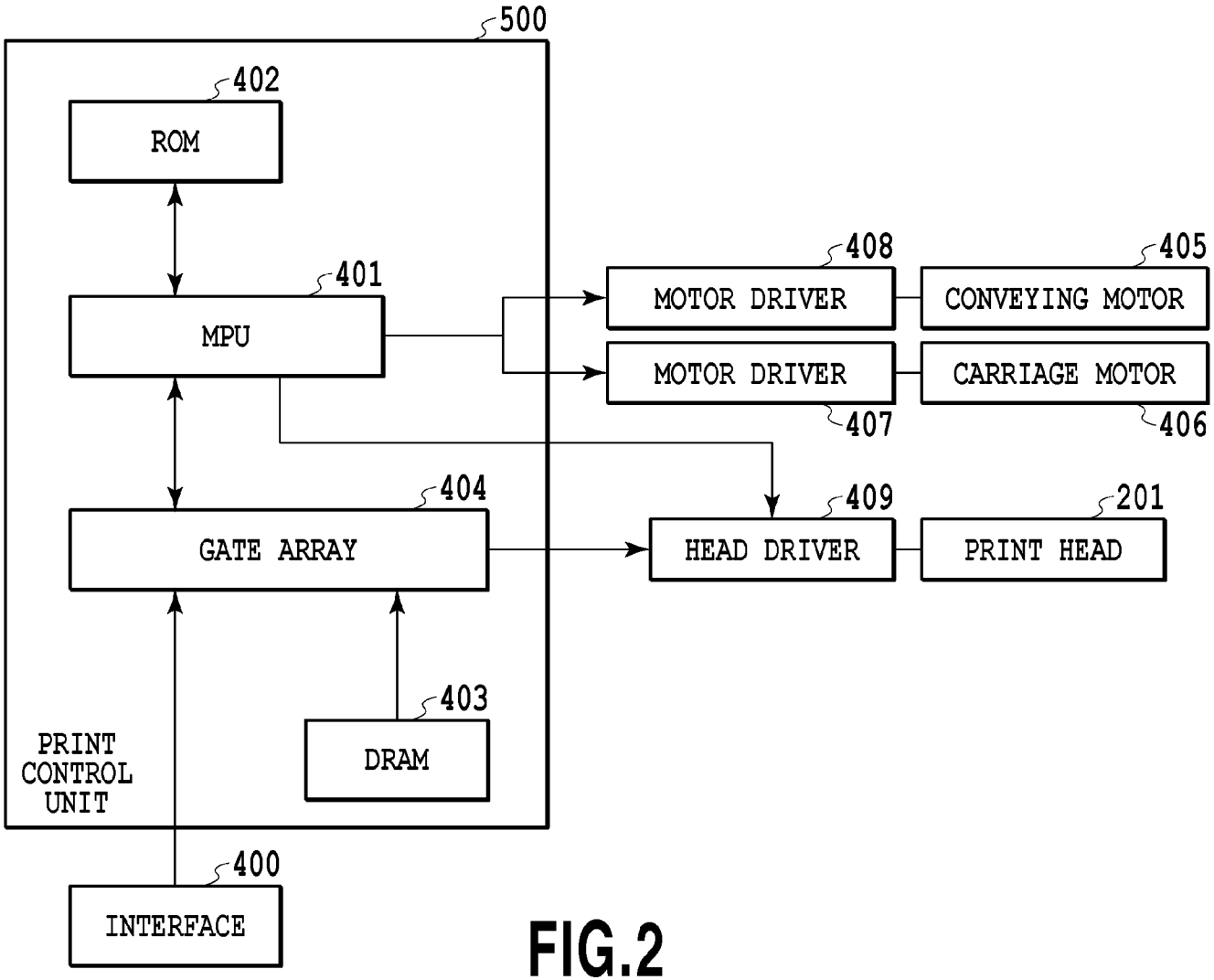
FIG. 2 is a block diagram illustrating the control configuration in the inkjet printing apparatus.

FIG. 2 is a block diagram for illustrating the control configuration in the inkjet printing apparatus in the present embodiment. A print control unit 500 is an area for controlling the entire printing apparatus for the printing operation. Mainly, a MPU 401 performs various processes on image data received through an interface 400 according to programs stored in a ROM 402 while using a DRAM 403 as a work area. Then, the MPU 401 performs a printing operation based on the image data after the processing, while driving various drivers. In this stage, a gate array 404 controls data transfer among the interface 400, the MPU 401 and the DRAM 403.

A motor driver 408 drives a conveying motor 405 for rotating the conveying roller 103 or the feeding roller 105 under the control of the MPU 401.

A motor driver 407 drives a carriage motor 406 for moving the carriage 106 in the X direction under the control of the MPU 401.

A head driver 409 transmits a drive signal for allowing the print head 201 to eject ink under the control of the MPU 401.

Embodiment 1

Figure 3:
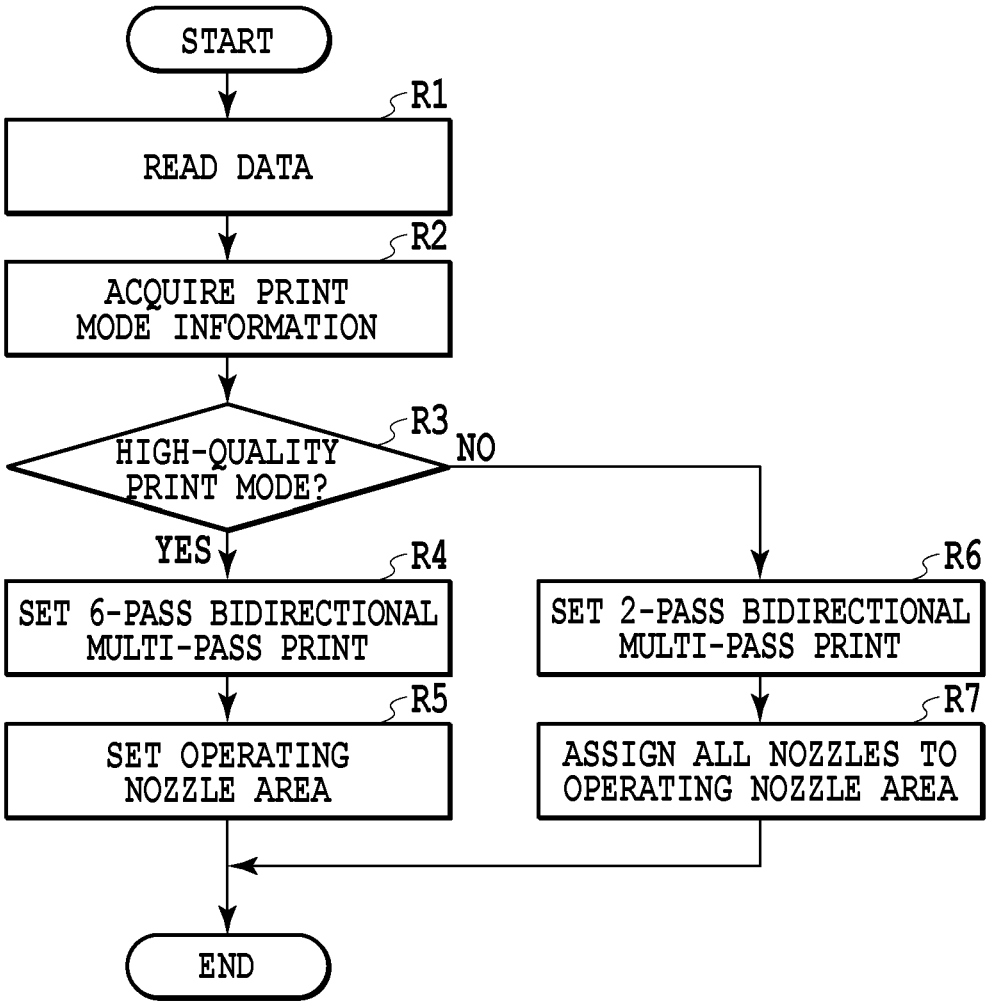
FIG. 3 is a flowchart showing the process of setting an operating nozzle area in Embodiment 1.

FIG. 3 is a flowchart showing the process of setting a print mode and an operating nozzle area of each nozzle array which are executed by the print control unit 500 upon reception of a print start command.

Upon reception of the print start command, in step R1, the print control unit 500 receives image data through the interface 400 and temporarily stores it in the DRAM 403. Then, in step R2, the print control unit 500 analyzes a header of the image data to acquire the set print mode.

It is determined in step R3 whether or not the acquired print mode is a high-quality mode. If it is the high-quality mode, the process goes to step R4. If it is not the high-quality mode, the process goes to step R6.

Figure 4A:
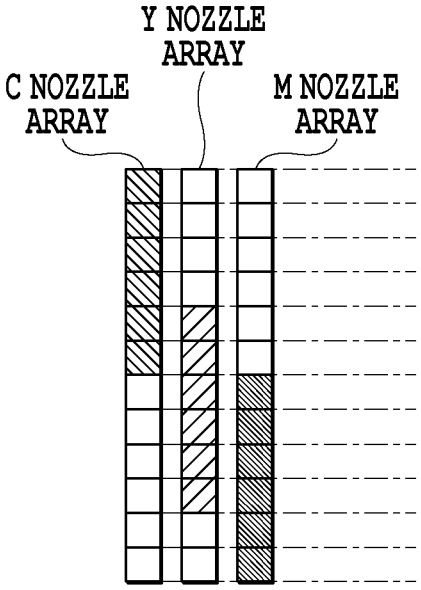
FIGS. 4A and 4B are diagrams showing the nozzle operating areas in a high-quality mode and a high-speed mode.

In step R4, according to the high-quality mode, the print method is set to 6-pass bidirectional multi-pass printing. Then, in step R5, an operating area of each nozzle array is set as illustrated in FIG. 4A. On the other hand, in step R6, according to the high-speed mode, the print method is set to 2-pass bidirectional multi-pass printing, and then in step R7, the full areas of all nozzle arrays are set as an operating area as illustrated in FIG. 4B.

Figure 4B:
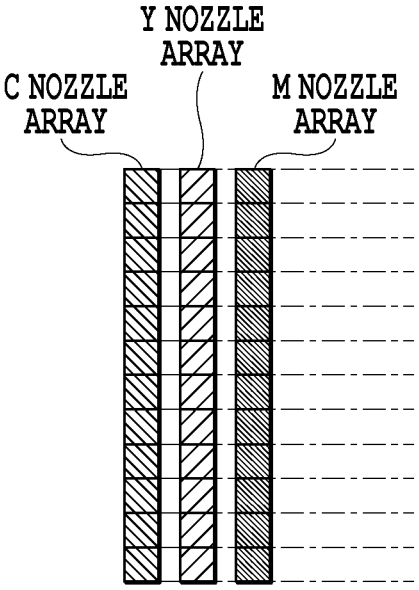

FIGS. 4A and 4B are diagrams respectively showing the nozzle operating areas in the high-quality mode and the high-speed mode in the present embodiment. In the print head in the present embodiment, 384 nozzles are arranged in each nozzle array in the Y direction. In the interest of simplicity, the nozzle arrays for three colors of cyan (C), magenta (M) and yellow (Y) will be herein described.

FIG. 4A shows the operating nozzle area of each nozzle array in the high-quality mode. This case illustrates the 384 nozzles divided into 12 blocks each having 32 nozzles. In FIG. 4A, filled-in areas (6 blocks for each color) represent operating nozzle areas from which ink is actually ejected, and white areas represent non-operating nozzle areas from which ink is not ejected. In the cyan nozzle array, the first to sixth blocks from the top in FIG. 4A are assigned to an operating nozzle area. In the yellow nozzle array, the fifth to tenth blocks from the top in FIG. 4A are assigned to an operating nozzle area. In the magenta nozzle array, the seventh to twelfth blocks from the top in FIG. 4A are assigned to an operating nozzle area. Such operating areas are set when a printing is performed to middle region of the print medium. The middle region may include center of the print medium but does not have to include the center. In a case in which the conveying distance for printing to leading end and rear end of the print medium is set larger than the conveying distance for printing to middle region of the print medium, the conveying distance of conveying operation repeated several times for printing to middle region is the largest.

In each nozzle array, the 6 adjacent blocks are assigned to the operating nozzle area, and differ in positions in the Y direction from those in another nozzle array. In this case, the cyan operating nozzle area and the magenta operating nozzle area do not overlap with each other, while the yellow operating nozzle area partially overlaps the cyan operating nozzle area and the magenta operating nozzle area. In step R5 in FIG. 3, the operating nozzle area is set in this manner.

FIG. 4B is a diagram showing the operating area of each nozzle array in a high-speed mode. In the high-speed mode, the full areas in all the cyan, magenta and yellow nozzle arrays are set as an operating area. In step R7 in FIG. 3 the operating nozzle area is set in this manner.

Figure 5:
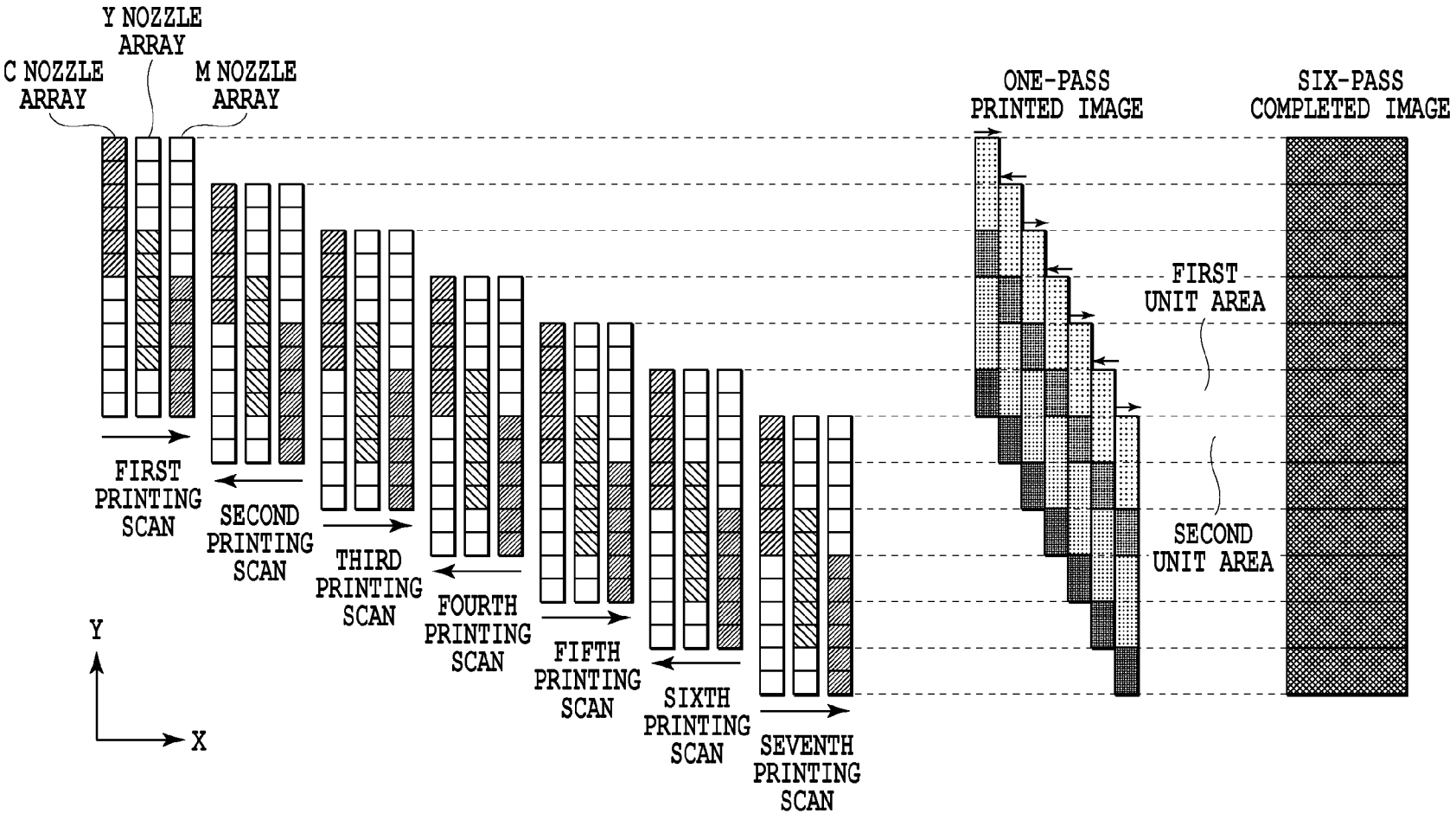
FIG. 5 is a diagram showing the print state in the high-quality print mode in Embodiment 1.

FIG. 5 is a diagram showing the print state in the high-quality print mode in the present embodiment. Since the high-quality print mode in the present embodiment is 6-pass multi pass printing, the print medium is conveyed by one-sixth of a nozzle array, that is, by two blocks, in the Y direction for each printing scan. FIG. 5 shows the positions of the nozzle arrays relative to the print medium which are shifted in the Y direction for each printing scan. In this connection, if an area corresponding to an amount of conveyance of the print medium conveyed in one conveying operation (two-block area) is defined as a unit area, on each unit area, an image is completed through six printing scans in total made up of forward scans and backward scans performed by the print head 201.

In FIG. 5, attention is focused on a first unit area. Printing on this unit area is done by from the first printing scan to the sixth printing scan. More specifically, in the first printing scan, magenta is applied during the forward scan. In the second printing scan, yellow and magenta are applied during the backward scan. In the third printing scan, yellow and magenta are applied during the forward scan. In the fourth printing scan, cyan and yellow are applied during the backward scan. In the fifth printing scan, cyan is applied during the forward scan. In the sixth printing scan, cyan is applied during the backward scan. In short, the color order in which inks are applied to the first unit area is magenta first, yellow and magenta second, yellow and magenta third, cyan and yellow fourth, and then cyan followed by cyan.

On the other hand, attention is focused on a second unit area adjacent to the first unit area. Printing on this unit area is done by from the second printing scan to the seventh printing scan. More specifically, in the second printing scan, magenta is applied during the backward scan. In the third printing scan, yellow and magenta are applied during the forward scan. In the fourth printing scan, yellow and magenta are applied during the backward scan. In the fifth printing scan, cyan and yellow are applied during the forward scan. In the sixth printing scan, cyan is applied during the backward scan. In the seventh printing scan, cyan is applied during the forward scan. In short, likewise, the color order in which inks are applied to the second unit area is magenta first, yellow and magenta second, yellow and magenta third, cyan and yellow fourth, and then cyan followed by cyan.

In this manner, the ink application process for either of the first and second unit areas includes the same process of magenta→yellow and magenta→yellow and magenta→cyan and yellow→cyan→cyan. The printing scans are performed for odd-numbered unit areas, such as a third unit area, a fifth unit area and a seventh unit area, in the same process as that for the first unit area. Likewise, the printing scans are performed for even-numbered unit areas, such as a fourth unit area, a sixth unit area and an eighth unit area, in the same process as that for the second unit area. That is, if 6-pass bidirectional printing as described in FIG. 5 is done in the operating nozzle areas described in FIG. 4A, it is possible to unify the ink application order for all the unit areas.

Figure 6A:
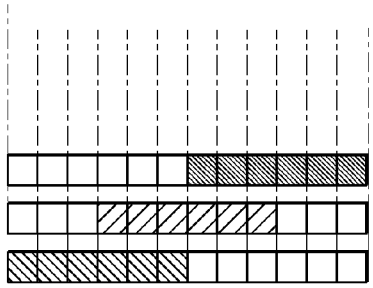
FIGS. 6A and 6B show comparison examples in Embodiment 1.
Figure 6B:
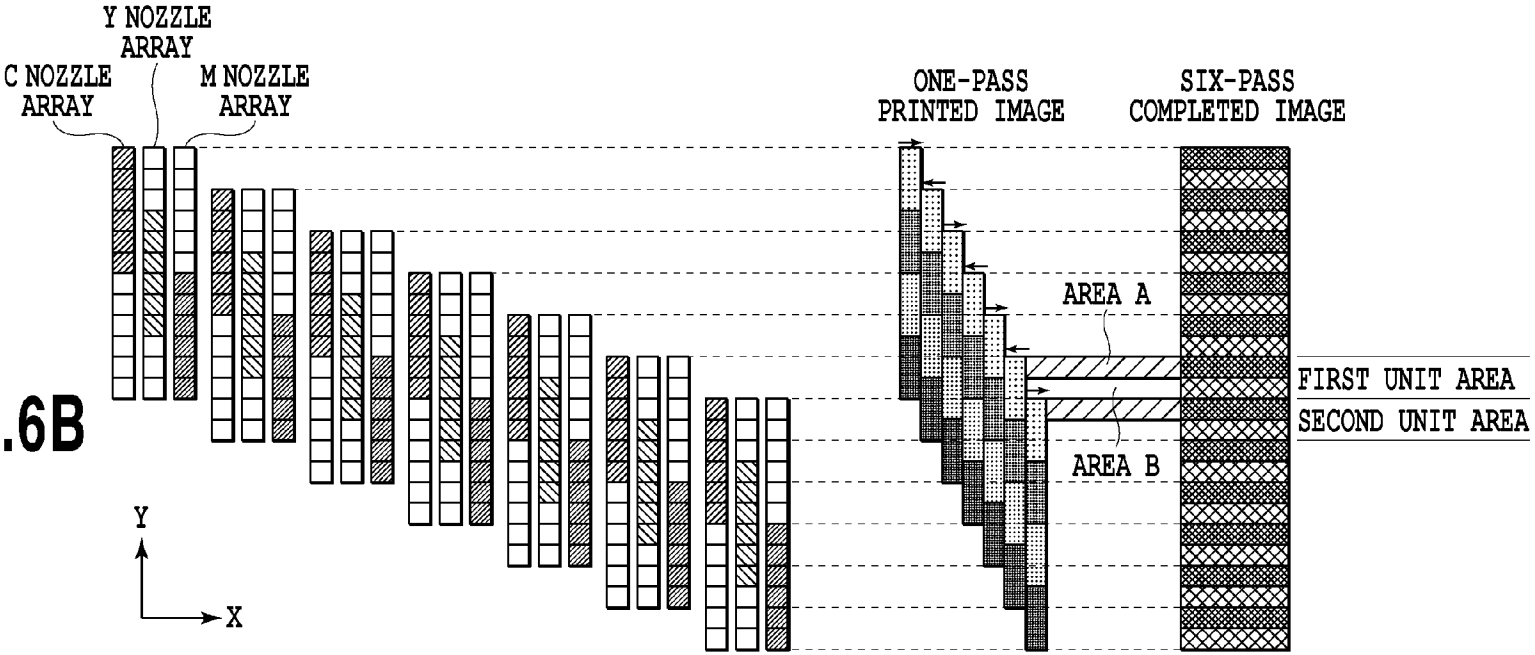

FIGS. 6A and 6B are comparison examples with the high-quality mode in the present embodiment illustrated in FIGS. 4A and 5. FIG. 6A shows operating nozzle areas in a comparison example, while FIG. 6B shows a print state in a comparison example.

Referring to FIG. 6A, in the comparison example, 6 adjacent blocks in each nozzle array are assigned to the operating nozzle area, and differ in positions in the Y direction from those in another nozzle array. In this case, the operating nozzle areas of the cyan nozzle array and the magenta nozzle array are the same as those in the present embodiment shown in FIG. 4A, but the operating nozzle area of the yellow nozzle array differs from that in the present embodiment. In the present embodiment, the fifth to tenth blocks from the top of the yellow nozzle array are assigned to an operating nozzle area, but in the comparison example, the fourth to ninth blocks from the top are assigned to an operating nozzle area.

In such a comparison example, an image is able to be printed by 6-pass multi pass printing as shown in FIG. 6B. For each unit area, the process of applying the inks can be unified. However, in a case of FIG. 6B, one unit area includes two areas in which printing is done in the different application processes.

This is described concretely. By referring to FIG. 6B, when attention is focused on a first unit area, printing on this unit area is done thorough from the first printing scan to the sixth printing scan. However, an A area and a B area included in the first unit area differ in the process of applying the inks. To the A area, magenta is applied in the forward scan of the first printing scan, and then yellow and magenta are applied in the backward scan in the second printing scan. Then, yellow and magenta are applied in the forward scan in the third printing scan, and then cyan and yellow are applied in the backward scan in the fourth printing scan. Then, cyan is applied in the forward scan in the fifth printing scan, and then cyan is applied in the backward scan in the sixth printing scan.

On the other hand, to the B area, magenta is applied in the forward scan of the first printing scan, and then magenta is applied in the backward scan in the second printing scan. Then, yellow and magenta are applied in the forward scan in the third printing scan, and then cyan and yellow are applied in the backward scan in the fourth printing scan. Then, cyan and yellow are applied in the forward scan in the fifth printing scan, and then cyan is applied in the backward scan in the sixth printing scan.

In other words, in the second printing scan, yellow and magenta are applied to the A area, but only magenta is applied to the B area. Likewise, in the fifth printing scan, only cyan is applied to the A area, but cyan and yellow are applied to the B area. As a result, an ink application process for the A area includes the process of magenta→yellow and magenta→yellow and magenta→cyan and yellow→cyan→cyan, and an ink application process for the B area includes the process of magenta→magenta→yellow and magenta→cyan and yellow→cyan and yellow→cyan. In this manner, if 6-pass bidirectional printing as shown in FIG. 6B is done to the operating nozzle area described in FIG. 6A, it becomes impossible to unify the ink application order for all the unit areas.

Differences between the present embodiment and the comparison example as described above result from differences in operating-nozzle area setting of the yellow nozzle array from the cyan and magenta nozzle arrays. Specifically, in the comparison example, since an overlapping area of cyan and yellow or an overlapping area of magenta and yellow is not an integral multiple of the amount of conveyance of the print medium, the area A and the area B differing in the ink application process from each other are created in one single unit area. The inventors have focused on such a phenomenon from assiduous study. As a result, they have arrived at the knowledge that, even when operating nozzle areas of a plurality of nozzle arrays are determined to partially overlap with each other, if the operating nozzle areas are set such that the mutual overlapping area is synchronized with a conveying pitch, it is possible to unify the processes of applying the inks in all unit areas.

Based on such a theory, in the high-quality mode in the present embodiment, the overlapping area of cyan and yellow corresponds to two blocks and the overlapping area of magenta and yellow corresponds to four blocks as shown in FIG. 4A such that either of the two areas becomes an integral multiple of the amount of conveyance corresponding to two blocks. On the other hand, in the comparison example, the overlapping area of cyan and yellow corresponds to three blocks and also the overlapping area of magenta and yellow corresponds to three blocks. Either of the two overlapping areas is not equal to an integral multiple of the amount of conveyance corresponding to two blocks.

Figure 7A:
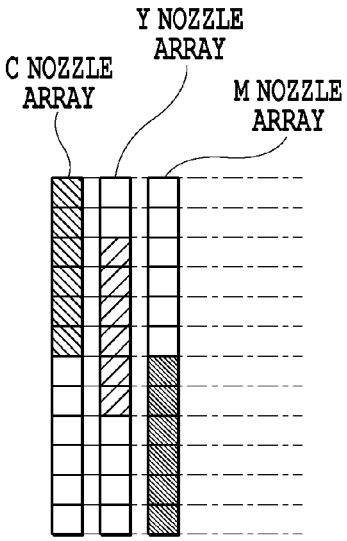
FIGS. 7A to 7C are diagrams showing other examples of set patterns of the operating nozzle areas which are applicable or inapplicable to the present invention.
Figure 7B:
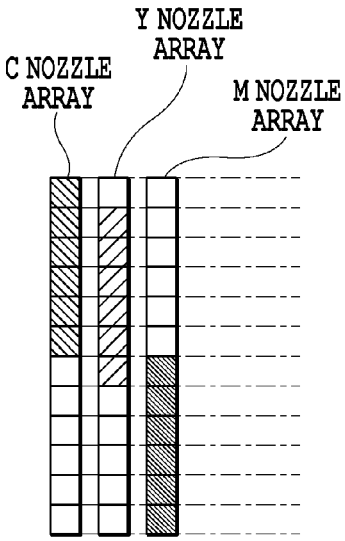
Figure 7C:
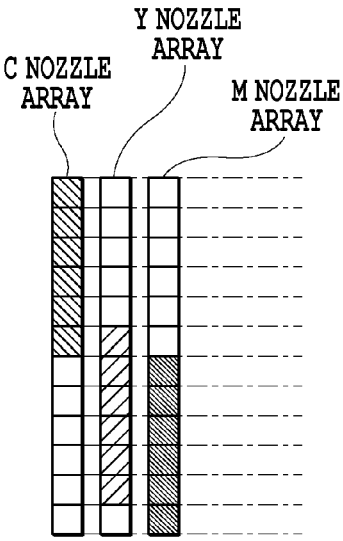

FIGS. 7A to 7C are diagrams showing other examples of a set pattern of the operating nozzle area which is applicable to the present embodiment and set patterns of the operating nozzle areas which are inapplicable to the present embodiment. FIG. 7A shows an overlapping area of cyan and yellow corresponding to four blocks and an overlapping area of magenta and yellow corresponding to two blocks, in which either of the two overlapping areas is equal to an integral multiple of the amount of conveyance. Accordingly, the set pattern of the operating nozzle array is applicable to the embodiment. On the other hand, FIG. 7B shows an overlapping area of cyan and yellow corresponding to one block and an overlapping area of magenta and yellow corresponding to five blocks, in which the overlapping area is not equal to an integral multiple of the amount of conveyance. FIG. 7C shows an overlapping area of cyan and yellow corresponding to five blocks and an overlapping area of magenta and yellow corresponding to one block, in which the overlapping area is not an integral multiple of the amount of conveyance. Accordingly, either of the patterns as illustrated in FIGS. 7B and 7C is inapplicable to the embodiment.

As described above, in the present embodiment, in the high-quality mode in which the 6-pass bidirectional multipass printing is performed, the operating nozzle areas of a plurality of the nozzle arrays are determined to partially overlap with each other in such a condition that the overlapping area of the operating nozzle areas of the adjacent nozzle arrays becomes equal to an integral multiple of the amount of conveyance. As a result, even in the structure in which the operating nozzle areas of a plurality of the nozzle arrays overlap with each other in the conveying direction, avoidance of color banding and gloss variations caused by non-uniformity in the ink application process is made possible.

Embodiment 2

The present embodiment also uses the inkjet printing apparatus described in FIG. 1 and FIG. 2. However, the present embodiment corrects print position shifts of individual nozzle arrays in the Y direction, in addition to the aforementioned structure in Embodiment 1.

In the inkjet printing apparatus including a plurality of nozzle arrays arranged in parallel in the main scan direction (X direction) as shown in FIG. 1, an error and the like developing in the manufacture process may possibly cause a shift of the order of some pixels to occur in a position in the Y direction of each nozzle array (vertical registration shift). In such an event, even if printing is performed in the same positions in the Y direction, a printed position shift between ink colors occurs. Therefore, for the purpose of correcting such a shift on an image, many inkjet printing apparatuses are provided with a structure in which a position of a nozzle causing actual printing of raster data continuing in the X direction is shifted in the Y direction. Adjusting such print position shift on a nozzle array basis makes it possible to align the Y-direction print positions of all the ink colors on the print medium.

Figure 8A:
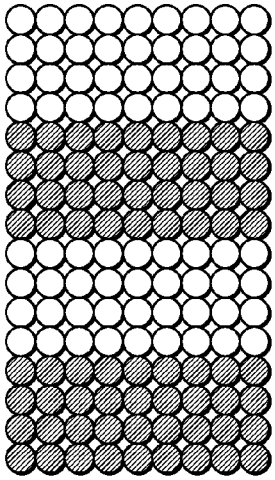
FIGS. 8A to 8C are diagrams showing test pattern examples for detecting vertical registration shifts.
Figure 8B:
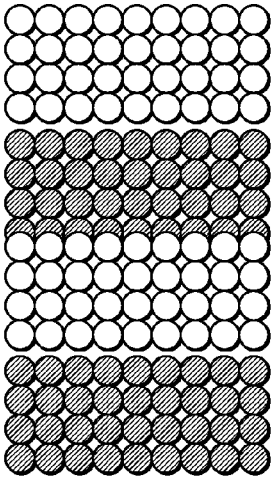
Figure 8C:
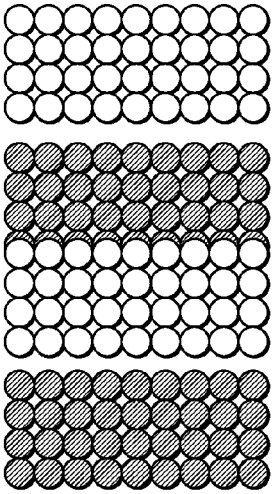

FIGS. 8A to 8C are diagrams showing an example of test patterns for detecting the amount of print position shifts in the Y direction of the two nozzle arrays. In this case, a gray circle denotes a dot printed by the first nozzle array, and a white circle denotes a dot printed by the second nozzle array. In the test patterns, a plurality of patterns are printed, in which while the print positions of the first nozzle array are fixed, the print positions of the second nozzle array are shifted by one pixel in the Y direction as shown in FIGS. 8A to 8C. Then, a pattern of the highest density, that is, with the smallest blank area, is selected based on, for example, user's visual determination or a detection result of a built-in density sensor. In this case, FIG. 8A is selected. Then, actual printing is performed by use of the amount of correction (shift amount) of the selected pattern.

Figure 9:
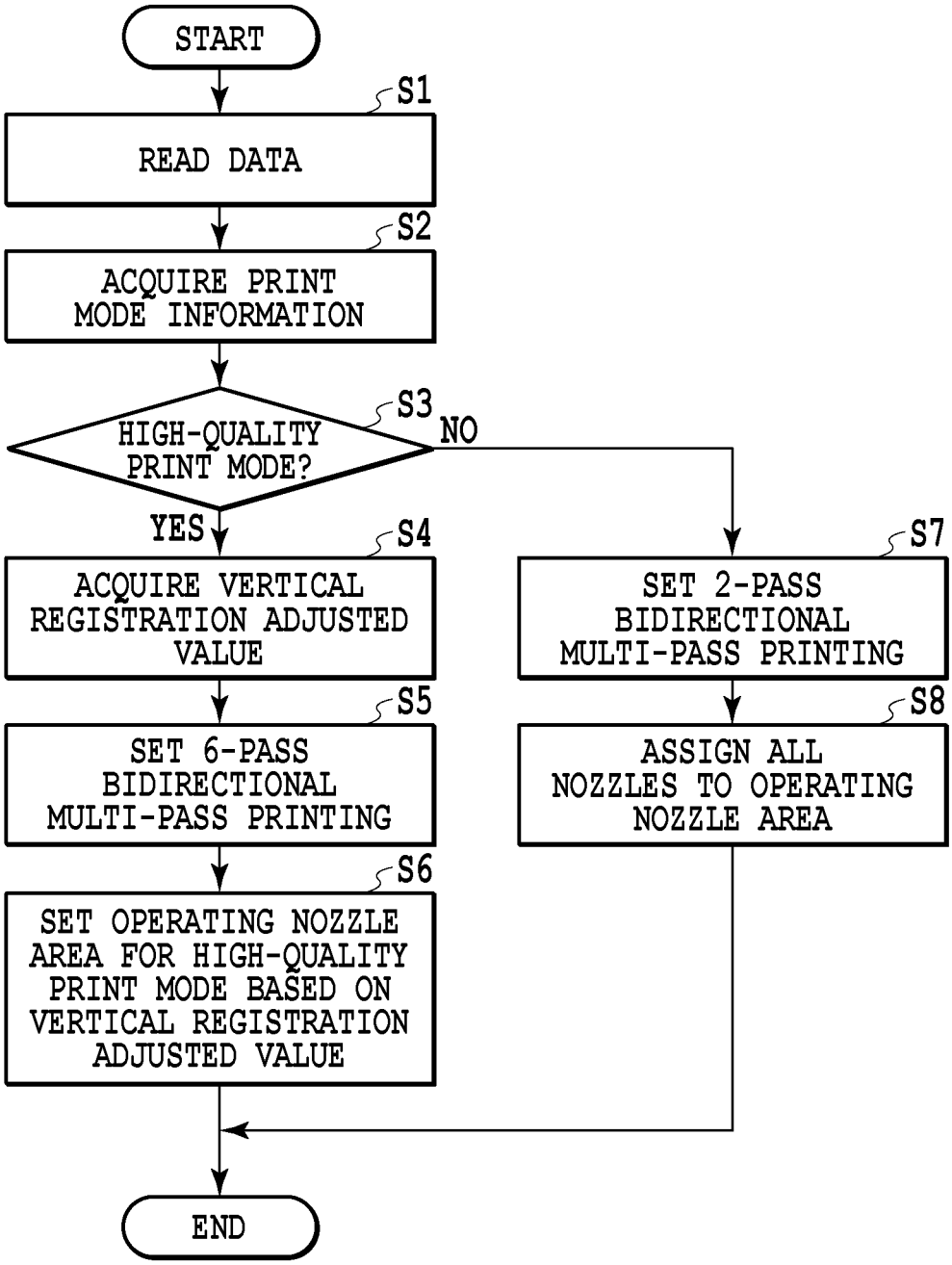
FIG. 9 is a flowchart showing the process of setting an operating nozzle area in Embodiment 2.

FIG. 9 is a flowchart showing the process of setting a print mode and an operating nozzle area which are executed by the print control unit 500 in the present embodiment upon reception of a print start command.

Upon reception of a print start command, in step S1, the print control unit 500 receives image data through the interface 400 and temporarily stores it in the DRAM 403. Then, in step S2, the print control unit 500 analyzes a header of the image data to acquire a set print mode.

It is determined in step S3 whether the acquired print mode is a high-quality mode or high-speed mode. If it is the high-quality mode, the process goes to step S4. If it is the high-speed mode, the process goes to step S7.

In step S4, the correction value for the vertical registration obtained previously by the aforementioned method and stored in the memory is acquired. Then, the process goes to step S5, wherein according to the high-quality mode, the print method is set to 6-pass bidirectional multi-pass printing. Then, in step S6, from the vertical registration adjusted value acquired in step S4 and the print mode set in step S5, an appropriate operating nozzle area of the nozzle array for each ink color is determined and set.

On the other hand, in step S7, according to the high-speed mode, the print method is set to 2-pass bidirectional multi-pass printing, and then in step S8, the full areas of all nozzle arrays are set as an operating area as illustrated in FIG. 4B, as in the case of Embodiment 1. The present process ends with termination of the above steps.

Figure 10A:
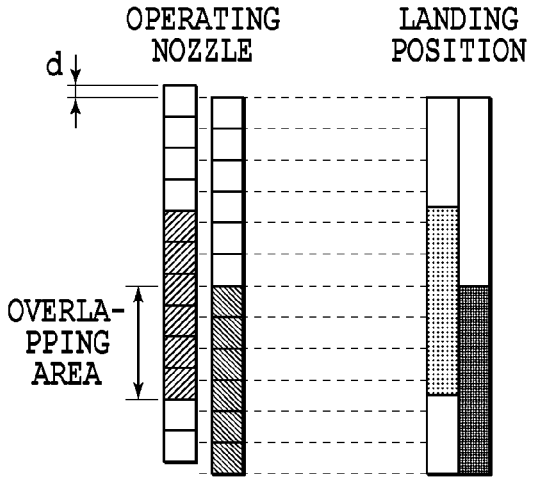
FIGS. 10A and 10B are diagrams illustrating a method of setting an operating nozzle area.
Figure 10B:
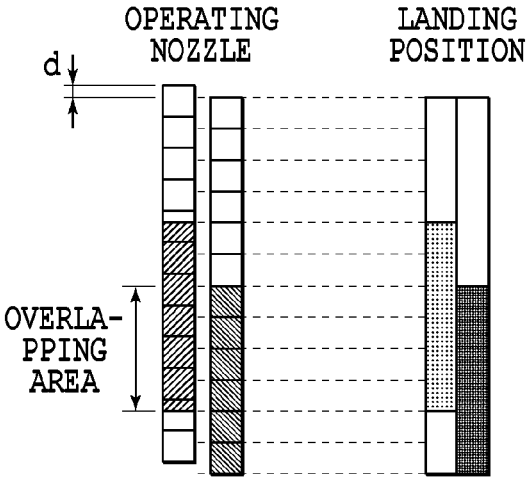

FIGS. 10A and 10B are diagrams illustrating a method of setting an operating nozzle area in step S6, which illustrate the state in which the yellow nozzle array is shifted from the magenta nozzle array in the Y direction by d.

FIG. 10A shows the print position of each nozzle array when printing similar to Embodiment 1 is performed before correcting such a print position shift. A yellow operating nozzle area is assigned to the fifth to tenth blocks from the top, while a magenta operating nozzle area is assigned to the seventh to twelfth blocks from the top. The data indicate that an overlapping area of the two nozzle arrays corresponds to four blocks. In fact, however, since the yellow nozzle array and the magenta nozzle array are shifted from each other by d, the overlapping area on the print medium results in 4 blocks-d, which is not an integral multiple of the amount of conveyance (2 blocks). That is, if the 6-pass bidirectional multi-pass is performed without any processing, areas in which different ink application processes are performed will occur in a unit area.

On the other hand, FIG. 10B shows the print position of each nozzle array when an operating nozzle area is set on the basis of the vertical registration adjusted value obtained in step S4. In this case, a yellow operating nozzle area is set to a position shifted by d from the fifth to tenth blocks arranged from the top. As a result of such setting of the operating nozzle area, the overlapping area on the print medium corresponds to just 4 blocks, which is an integral multiple of the amount of conveyance (2 blocks).

Figure 11A:
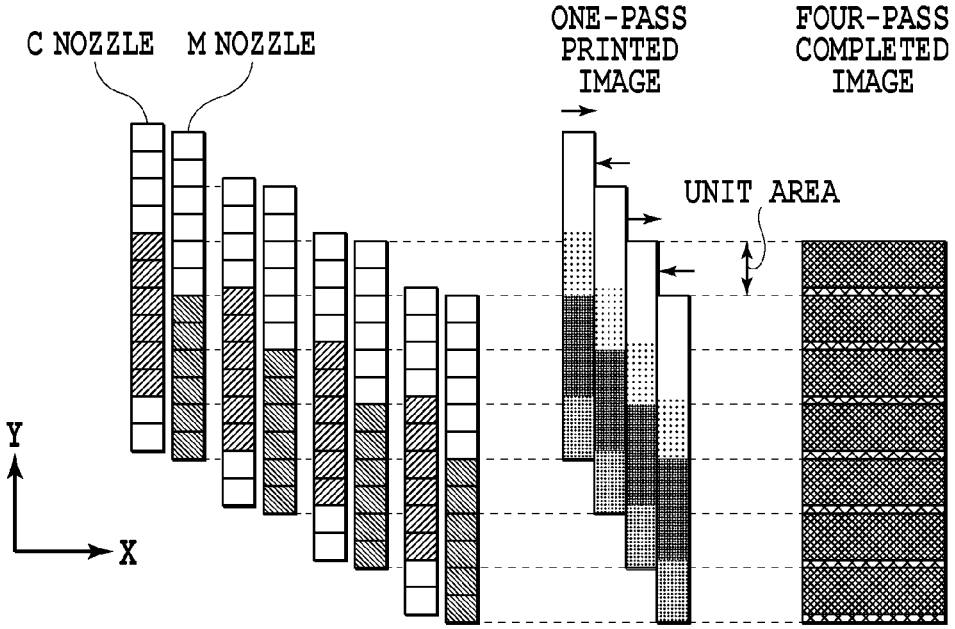
FIGS. 11A and 11B are diagrams each showing a print state when vertical-registration correction value is reflected and a print state when it is not reflected.
Figure 11B:
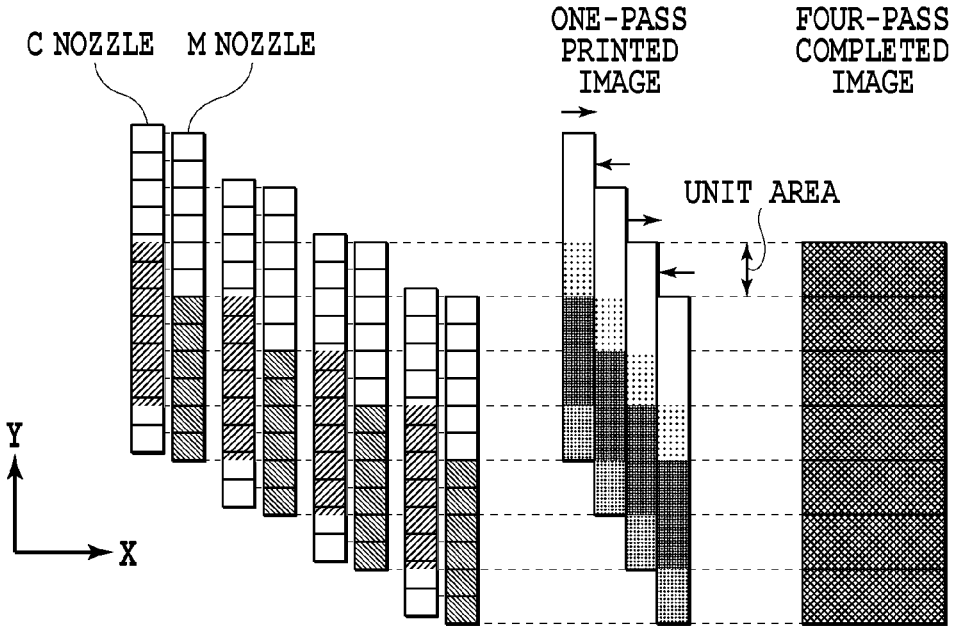

FIGS. 11A and 11B are diagrams showing a print state when vertical-registration correction value is reflected and a print state when it is not reflected in the high-quality print mode of the present embodiment. If an operating nozzle area is set as illustrated in FIG. 10A without reflecting the vertical-registration correction value, a print state on the print medium results in the state as illustrated in FIG. 11A. Two areas in which different ink application processes are performed occur in a unit area, resulting in color banding and gloss variations.

On the other hand, if the vertical-registration correction value is reflected to set an operating nozzle area as illustrated in FIG. 10B, a print state on the print medium results in the state as illustrated in FIG. 11B. Areas in which different ink application processes are performed do not occur in a unit area, resulting in neither color banding nor gloss variations.

For reference sake, in the high-speed mode in the present embodiment, since a print-position shift correction is not made, the print position shift will occur. This is because, in the high-speed mode, more importance is placed on improvement in print speed than on degradation in image quality following the print position shift. However, even in, for example, the 2-pass bidirectional print mode, if the presence of some non-operating nozzles is acknowledged, a set width of the operating nozzle area can be adjusted within a range of some pixels. In this manner, the 2-pass bidirectional high-speed print mode described in Embodiment 1 can be performed after the print position shift has been corrected.

As described above, in the present embodiment, in the high-quality mode in which the 6-pass bidirectional multi-pass printing is performed, the operating nozzle areas of a plurality of nozzle arrays are set in such a condition that an overlapping area of each color operating nozzle area becomes equal to an integral multiple of the amount of conveyance after the print position shift in the Y direction has been adjusted. As a result, even in a case of using a plurality of nozzle arrays of which the print positions in the Y direction are shifted from each other, lessening of color banding and gloss variations caused by non-uniformity in the ink application process is made possible.

Up to this point, the color inkjet printing apparatus using four color inks has been described, but the present invention is not limited to such a structure. The aforementioned embodiments are able to be applied to any serial type of inkjet printing apparatus having a plurality of nozzle arrays arranged in the main scan direction even if the number of nozzle arrays is two or four or more.

Also, the 6-pass bidirectional high-quality mode has been described by use of the 2-pass bidirectional high-speed mode for the sake of simplicity, but it should be understood that the present invention is able to be applied to an inkjet printing apparatus having further more print modes. Even in any defined print mode, if the operating nozzle areas of the individual nozzle arrays are set in such a condition that an overlapping area of a plurality of nozzles becomes an integral multiple of the amount of conveyance, advantageous effects as illustrated in a description on the high-quality mode can be provided.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-178944, filed Aug. 18, 2011, which is hereby incorporated by reference herein in its entirety.

What is claimed is:

1. An inkjet printing apparatus, which prints an image on a print medium by performing, in alternate order, a printing scan in which a plurality of nozzle arrays each including a plurality of nozzles arranged in a predetermined direction are moved relative to the print medium, and a conveying operation of conveying the print medium in the predetermined direction, comprising:

a setting unit configured to set an operating nozzle area, operated for printing to a middle region of the print medium, for each of the plurality of nozzle arrays;

a unit configured to execute the printing scan by moving the plurality of nozzle arrays in a direction crossing the predetermined direction while ink is ejected from the operating nozzle areas set by the setting unit; and a unit configured to execute the conveying operation of conveying the print medium in the predetermined direction by an amount of conveyance determined depending on a set print mode, wherein the setting unit sets the operating nozzle area for each of the plurality of nozzle arrays such that an overlapping area, in the predetermined direction, of the operating nozzle areas of the plurality of nozzle arrays is an integral multiple of the amount of conveyance.

2. The inkjet printing apparatus according to claim 1, further comprising: a correction unit configured to acquire, for each of the plurality of nozzle arrays, a correction value used for adjusting a print position on the print medium in the predetermined direction, wherein the setting unit sets the operating nozzle area for each of the plurality of nozzle arrays in accordance with the set print mode and the correction value acquired by the correction unit such that the overlapping area, in the predetermined direction, of the operating nozzle areas of the plurality of nozzle arrays is an integral multiple of the amount of conveyance.

3. The inkjet printing apparatus according to claim 1, wherein the plurality of nozzle arrays include nozzle arrays from which cyan, magenta, yellow and black inks are ejected.

4. An inkjet printing method for printing an image on a print medium by performing, in alternate order, a printing scan in which a plurality of nozzle arrays each including a plurality of nozzles arranged in a predetermined direction are moved relative to a print medium, and a conveying operation of conveying the print medium in the predetermined direction, comprising:

a setting step of setting an operating nozzle area, operated for printing to a middle region of the print medium, for each of the plurality of nozzle arrays;

a step of executing the printing scan by moving the plurality of nozzle arrays in a direction crossing the predetermined direction while ink is ejected from the operating nozzle areas set in the setting step; and a step of executing the conveying operation by conveying the print medium in the predetermined direction by an amount of conveyance determined depending on a set print mode, wherein the operating nozzle area for each of the plurality of nozzle arrays is set, in the setting step, sauch that an overlapping area, in the predetermined direction, of the operating nozzle areas of the plurality of nozzle arrays is an integral multiple of the amount of conveyance.

5. The inkjet printing method according to claim 4, further comprising:

a correction step of acquiring, for each of the plurality of nozzle arrays, a correction value used for adjusting a print position on the print medium in the predetermined direction, wherein the operating nozzle area for each of the plurality of nozzle arrays is set, in the setting step, in accordance with the set print mode and the correction value acquired in the correction step such that the overlapping area, in the predetermined direction, of the operating nozzle areas of the plurality of nozzle arrays is the integral multiple of the amount of conveyance.

6. The inkjet printing method according to claim 4, wherein the plurality of nozzle arrays include nozzle arrays from which cyan, magenta, yellow and black inks are ejected.

7. An inkjet printing apparatus comprising:

a print unit configured to execute a printing scan by moving a plurality of nozzle arrays, each including a plurality of nozzles arranged in a predetermined direction, in a direction crossing the predetermined direction relative to a print medium while ejecting ink;

a conveyance unit configured to execute a conveying operation of conveying the print medium in the predetermined direction by a conveyance amount determined depending on a determined print mode, wherein the printing scan by the print unit and the conveying operation of the conveying unit are executed in alternate order; and a setting unit configured to set an operating nozzle area, operated for printing to a middle region of the print medium, for each of the plurality of nozzle arrays in accordance with the determined print mode, such that (i) each of the operating nozzle areas is a part of the corresponding nozzle array, (ii) the operating nozzle areas are shifted in the predetermined direction with respect to each other, and (iii) a length of an overlapping area, in the predetermined direction, of the operating nozzle areas of the plurality of nozzle arrays corresponds to an integral multiple of the conveyance amount of the conveyance operation by the conveyance unit, wherein the print unit prints an image on the print medium using the operating nozzle areas set by the setting unit.

8. The inkjet printing apparatus according to claim 7, further comprising:

a correction unit configured to acquire, for each of the plurality of nozzle arrays, a correction value used for adjusting a print position on the print medium in the predetermined direction, wherein the setting unit sets the operating nozzle area for each of the plurality of nozzle arrays in accordance with the determined print mode and the correction value acquired by the correction unit such that the length of the overlapping area in the predetermined direction of the operating nozzle areas of the plurality of nozzle arrays corresponds the integral multiple of the conveyance amount.

9. The inkjet printing apparatus according to claim 7, further comprising:

a mode determining unit configured to determine a print mode by selecting one from a plurality print modes of which conveyance amounts of the conveyance operation by the conveyance unit are different from each other.

10. The inkjet printing apparatus according to claim 7, wherein a shifted amount of the operating nozzle areas of the plurality of nozzle arrays corresponds to an integral multiple of the conveyance amount of the conveyance operation by the conveyance unit.

11. The inkjet printing apparatus according to claim 9, wherein in a case that the mode determining unit determines a first print mode, the setting unit sets the operating nozzle area for each of the plurality of nozzle arrays such that (i) each of the operating nozzle areas is a part of the corresponding nozzle array, (ii) the operating nozzle areas are shifted in the predetermined direction with respect to each other, and (iii) the length of the overlapping area, in the predetermined direction, of the operating nozzle areas of the plurality of nozzle arrays corresponds to the integral multiple of the conveyance amount of the conveyance operation by the conveyance unit, and in a case that the mode determining unit determines a second print mode, the setting unit sets the operating nozzle area to an entire range of the nozzle array for each of the plurality of nozzle arrays.

12. The inkjet printing apparatus according to claim 9, wherein in a case that the mode determining unit determines a first print mode, the setting unit sets the operating nozzle area for each of the plurality of nozzle arrays such that a shifted amount of the operating nozzle areas of the plurality of nozzle arrays corresponds to an integral multiple of the conveyance amount of the conveyance operation by the conveyance unit.

13. The inkjet printing apparatus according to claim 11, wherein in a case that the mode determining unit determines the first print mode, the conveyance unit executes the conveyance operation for a first conveyance amount, and in a case that the mode determining unit determines the second print mode, the conveyance unit executes the conveyance operation for a second conveyance amount larger than the first conveyance amount.

14. The inkjet printing apparatus according to claim 11, wherein the print unit forms an image by executing a predetermined number of the print scans for an unit area of the print medium, and the predetermined number that is set in a case that the mode determining unit determines the first print mode is smaller than the predetermined number that is set in a case that the mode determining unit determines the second print mode.

15. The inkjet printing apparatus according to claim 7, wherein the conveyance unit sets the conveyance amount of the conveyance operation for printing on fore-end regions on the print medium to be smaller than the conveyance amount of the conveyance operation for printing on the middle region on the print medium.

16. The inkjet printing apparatus according to claim 7, wherein the conveyance unit sets the conveyance amount of the conveyance operation for printing on rear-end regions on the print medium to be smaller than the conveyance amount of the conveyance operation for printing on the middle region on the print medium.

17. The inkjet printing apparatus according to claim 7, wherein the plurality of nozzle arrays includes three nozzle arrays ejecting different color inks respectively, and wherein the setting unit sets the operating nozzle areas such that the operating nozzle areas of each of the three nozzle arrays is a part of the corresponding nozzle array, the operating nozzle areas of the three nozzle arrays are shifted in the predetermined direction with respect to each other, and a length of an overlapping area in the predetermined direction of the operating nozzle areas of two nozzle arrays of the three nozzle arrays corresponds to an integral multiple of the conveyance amount of the conveyance operation by the conveyance unit.

18. An inkjet printing method comprising:

a printing step of executing a printing scan by moving a plurality of nozzle arrays each including a plurality of nozzles arranged in a predetermined direction, in a direction crossing the predetermined direction relative to a print medium with ejecting ink from the nozzles;

a conveying step of executing a conveying operation of conveying the print medium in the predetermined direction by a conveyance amount determined depending on a determined print mode, wherein the printing scan in the printing step and the conveying operation in the conveying step are executed in alternate order; and a setting step of setting an operating nozzle area, operated for printing to a middle region of the print medium, for each of the plurality of nozzle arrays in accordance with the determined print mode, such that (i) each of the operating nozzle areas is a part of the corresponding nozzle array, (ii) the operating nozzle areas are shifted in the predetermined direction with respect to each other, and (iii) a length of an overlapping area, in the predetermined direction, of the operating nozzle areas of the plurality of nozzle arrays corresponds to an integral multiple of the conveyance amount of the conveyance operation executed in the conveyance step, wherein the printing step prints an image on the print medium using the operating nozzle areas set in the setting step.

19. The inkjet printing method according to claim 18, further comprising:

a correcting step of acquiring, for each of the plurality of nozzle arrays, a correction value used for adjusting a print position on the print medium in the predetermined direction, wherein the operating nozzle area for each of the plurality of nozzle arrays is set, in the setting step, in accordance with the determined print mode and the correction value acquired in the correcting step such that the length of the overlapping area in the predetermined direction of the operating nozzle area between the plurality of nozzle arrays corresponds the integral multiple of the conveyance amount.

20. The inkjet printing method according to claim 18, further comprising:

a mode determining step of determining a print mode by selecting one from a plurality print modes of which conveyance amounts of the conveyance operation in the conveying step are different from each other.

21. The inkjet printing method according to claim 18, wherein a shifted amount of the operating nozzle areas of the plurality of nozzle arrays corresponds to an integral multiple of the conveyance amount of the conveyance operation executed in the conveyance step.

22. The inkjet printing method according to claim 20, wherein in a case that a first print mode is determined, in the mode determining step, the operating nozzle area for each of the plurality of nozzle arrays is set, in the setting step, such that (i) each of the operating nozzle areas is a part of the corresponding nozzle array, (ii) the operating nozzle areas are shifted in the predetermined direction with respect to each other, and (iii) the length of the overlapping area, in the predetermined direction, of the operating nozzle areas of the plurality of nozzle arrays corresponds to the integral multiple of the conveyance amount of the conveyance operation executed in the conveyance step, and in a case that a second print mode is determined, in the mode determining step, the operating nozzle area is set, in the setting step, to an entire range of the nozzle array for each of the plurality of nozzle arrays.

* * * * *